US008882992B2

(12) United States Patent
Chen et al.

(10) Patent No.: US 8,882,992 B2
(45) **Date of Patent: *Nov. 11, 2014**

(54) MULTI-STAGE REFORMING PROCESS TO PRODUCE HIGH OCTANE GASOLINE

(71) Applicants: Cong-Yan Chen, Alameda, CA (US); Stephen J. Miller, San Francisco, CA (US); James N. Ziemer, Martinez, CA (US)

(72) Inventors: Cong-Yan Chen, Alameda, CA (US); Stephen J. Miller, San Francisco, CA (US); James N. Ziemer, Martinez, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/084,181

(22) Filed: Nov. 19, 2013

(65) Prior Publication Data

US 2014/0076778 A1 Mar. 20, 2014

Related U.S. Application Data

(63) Continuation of application No. 12/845,615, filed on Jul. 28, 2010, now Pat. No. 8,658,021, which is a continuation of application No. 12/134,153, filed on Jun. 5, 2008, now abandoned.

(51) Int. Cl.

| | |
|---|---|
| ***C10G 59/02*** | (2006.01) |
| ***C10G 35/085*** | (2006.01) |
| ***C10G 35/24*** | (2006.01) |
| ***C10G 35/09*** | (2006.01) |

(52) U.S. Cl.

CPC ..... *G10G 59/02* (2013.01); *C10G 2400/02* (2013.01); *C10G 2300/1044* (2013.01); *C10G 35/24* (2013.01); *C10G 35/085* (2013.01); *C10G 2300/305* (2013.01); *C10G 35/09* (2013.01); *C10G 2300/4012* (2013.01); *C10G 2300/4006* (2013.01)

USPC ..... 208/64; 208/63; 208/65; 208/134; 208/138; 208/140

(58) Field of Classification Search

CPC ..... C10G 35/04; C10G 35/085; C10G 35/24; C10G 59/02

USPC ..... 208/63–65, 134, 137–138, 140–141

See application file for complete search history.

(56) References Cited

U.S. PATENT DOCUMENTS

| | | | |
|---|---|---|---|
| 3,770,614 | A | 11/1973 | Graven |
| 4,181,599 | A | 1/1980 | Miller et al. |

(Continued)

FOREIGN PATENT DOCUMENTS

| | | |
|---|---|---|
| EP | 517851 | 12/1992 |
| WO | WO9113127 | 9/1991 |

*Primary Examiner* — Renee E Robinson

(74) *Attorney, Agent, or Firm* — E. Joseph Gess; Michael D. Ross; Melissa M. Hayworth

(57) ABSTRACT

The present invention relates to a multistage reforming process to produce a high octane product. A naphtha boiling range feedstock is processed in a multi-stage reforming process, in which the process involves at least 1) a penultimate stage for reforming the naphtha feedstock to produce a penultimate effluent 2) a final stage for further reforming at least a portion of the penultimate effluent 3) a regeneration step for the final stage catalyst. The severity of the penultimate stage can be increased during final stage catalyst regeneration in order to maintain the target RON of the reformate product and avoid reactor downtime.

8 Claims, 2 Drawing Sheets

(56) References Cited

U.S. PATENT DOCUMENTS

| | | | | |
|---|---|---|---|---|
| 4,190,519 | A | 2/1980 | Miller et al. | |
| 4,354,925 | A | 10/1982 | Schorfheide | |
| 4,401,555 | A | 8/1983 | Miller | |
| 4,443,326 | A | 4/1984 | Field | |
| 4,457,832 | A | 7/1984 | Robinson | |
| 4,627,909 | A | 12/1986 | Robinson | |
| 4,764,267 | A | 8/1988 | Chen et al. | |
| 5,052,561 | A | 10/1991 | Miller et al. | |
| 5,073,250 | A | 12/1991 | Kline et al. | |
| 5,155,075 | A | 10/1992 | Innes et al. | |
| 5,169,813 | A | 12/1992 | Miller et al. | |
| 5,171,691 | A | 12/1992 | Kline et al. | |
| 5,182,012 | A | 1/1993 | Miller et al. | |
| 5,294,328 | A | 3/1994 | Schmidt et al. | |
| 5,347,061 | A | 9/1994 | Harandi et al. | |
| 5,358,631 | A | 10/1994 | Miller et al. | |
| 5,376,259 | A | 12/1994 | Kline et al. | |
| 5,407,558 | A | 4/1995 | Kline et al. | |
| 5,430,218 | A | 7/1995 | Miller et al. | |
| 5,516,961 | A | 5/1996 | Miller et al. | |
| 5,883,031 | A | 3/1999 | Innes et al. | |
| 5,958,217 | A | 9/1999 | Nacamuli et al. | |
| 6,063,723 | A | 5/2000 | Miller | |
| 6,323,381 | B1 | 11/2001 | Nacamuli et al. | |
| 2006/0213811 | A1* | 9/2006 | Clay et al. | 208/137 |
| 2009/0301933 | A1 | 12/2009 | Miller et al. | |
| 2009/0301934 | A1 | 12/2009 | Miller et al. | |
| 2012/0024752 | A1 | 2/2012 | Chen | |
| 2012/0024754 | A1 | 2/2012 | Chen | |
| 2012/0029257 | A1 | 2/2012 | Chen | |

* cited by examiner

MULTI-STAGE REFORMING PROCESS TO PRODUCE HIGH OCTANE GASOLINE

RELATED APPLICATIONS

This application claims priority as a continuation application of U.S. patent application Ser. No. 12/845,615, filed Jul. 28, 2010, which in turn claims priority as a continuation application to U.S. patent application Ser. No. 12/134,153, filed Jun. 5, 2008. This application claims priority to and benefits from the foregoing applications, the disclosures of which are incorporated herein by reference in their entirety.

FIELD OF THE INVENTION

The present invention relates to a multistage naphtha reforming process using an interstage separation step to produce a high octane product at high liquid yield and hydrogen production.

BACKGROUND OF THE INVENTION

Catalytic reforming is one of the basic petroleum refining processes for upgrading light hydrocarbon feedstocks, frequently referred to as naphtha feedstocks. Products from catalytic reforming can include high octane gasoline useful as automobile fuel, aromatics (for example benzene, toluene, xylenes and ethylbenzene), and/or hydrogen. Reactions typically involved in catalytic reforming include dehydrocylization, isomerization and dehydrogenation of naphtha range hydrocarbons, with dehydrocyclization and dehydrogenation of linear and slightly branched alkanes and dehydrogenation of cycloparaffins leading to the production of aromatics. Dealkylation and hydrocracking are generally undesirable due to the low value of the resulting light hydrocarbon products.

Catalysts commonly used in commercial reforming reactions often include a Group VIII metal, such as platinum or palladium, or a Group VIII metal plus a second catalytic metal, which acts as a promoter. Examples of metals useful as promoters include rhenium, tin, tungsten, germanium, cobalt, nickel, rhodium, ruthenium, iridium or combinations thereof. The catalytic metal or metals may be dispersed on a support such as alumina, silica, or silica-alumina. Typically, a halogen such as chlorine is incorporated on the support to add acid functionality. In addition to Group VIII metals, other reforming catalysts include aluminosilicate zeolite catalysts. For example, U.S. Pat. Nos. 3,761,389, 3,756,942 and 3,760,024 teach aromatization of a hydrocarbon fraction with a ZSM-5 type zeolite catalyst. U.S. Pat. No. 4,927,525 discloses catalytic reforming processes with beta zeolite catalysts containing a noble metal and an alkali metal. Other reforming catalysts include other molecular sieves such as borosilicates and silicoaluminophosphates, layered crystalline clay-type phyllosilicates, and amorphous clays.

In addition to selection of catalysts for reforming, various processes for reforming a naphtha feedstock in one or more process steps to produce higher value reformate products are known in the art. U.S. Pat. No. 3,415,737 teaches a process for reforming naphtha under conventional mild reforming conditions with a platinum-rhenium-chloride reforming catalyst to increase the aromatics content and octane number of the naphtha. In U.S. Pat. No. 3,770,614 there is disclosed a process in which a reformate is fractionated and the light reformate fraction ($C_6$ fraction) passed over a ZSM-5-type zeolite to increase aromatic content of the product. U.S. Pat. No. 3,950,241 discloses a process for upgrading naphtha by separating it into low- and high-boiling fractions, reforming the low-boiling fraction, combining the high-boiling naphtha with the reformate, and contacting the combined fractions with a ZSM-5-type catalyst. U.S. Pat. No. 4,181,599 discloses a process for reforming naphtha comprising separating the naphtha into heavy and light fractions and reforming and isomerizing the naphtha fractions. U.S. Pat. No. 4,190,519 teaches a process for upgrading a naphtha-boiling-range hydrocarbon which comprises separating the naphtha feedstock into a light naphtha fraction containing C6 paraffins and lower-boiling hydrocarbons and a heavy naphtha fraction containing higher-boiling hydrocarbons, reforming the heavy naphtha fraction and passing at least a portion of the reformate together with the light naphtha fraction over a zeolite catalyst to produce an aromatics-enriched effluent. Different catalysts may be employed in different process steps during the reforming of naphtha feedstocks as described in U.S. Pat. No. 4,627,909, U.S. Pat. No. 4,443,326, U.S. Pat. No. 4,764,267, U.S. Pat. No. 5,073,250, U.S. Pat. No. 5,169,813, U.S. Pat. No. 5,171,691, U.S. Pat. No. 5,182,012, U.S. Pat. No. 5,358,631, U.S. Pat. No. 5,376,259 and U.S. Pat. No. 5,407,558, for example.

Even with the advances in naphtha reforming catalysts and processes, a need still exists to develop new and improved reforming methods to provide higher liquid yield, improve hydrogen production, and minimize the formation of less valuable low molecule weight ($C_1$-$C_4$) products. It has been discovered that interstage feed separation in a staged reforming process and lower pressure in the final stage of a multistage reforming process can improve the RON (Research Octane Number), aromatics content, $C_5$+ liquid yield, hydrogen production, and catalyst life.

SUMMARY OF THE INVENTION

The present invention is based on the discovery that in a multi-stage reforming process, selective reforming of $C_5$-$C_8$ hydrocarbons in a separate or additional reforming stage provides improved performance of the overall reforming process of naphtha feedstocks.

The present invention relates to processes for catalytically reforming a naphtha feed to produce a product reformate in a multistage reforming operation. The process comprises (1) contacting a naphtha boiling range feedstock in a penultimate stage of a multi-stage reforming process at a first reforming pressure with a first reforming catalyst to produce a penultimate effluent; (2) separating at least a portion of the penultimate effluent into at least an intermediate reformate comprising at least 70 vol % $C_5$-$C_8$ hydrocarbons and a heavy reformate comprising at least 70 vol % $C_{9+}$ hydrocarbons; and (3) contacting the intermediate reformate in a final stage of the multi-stage reforming process at a second reforming pressure with a second reforming catalyst to produce a final effluent comprising a final reformate, wherein the final reformate has a higher RON than the intermediate reformate. Preferably the pressure in the final stage is lower than the pressure in the penultimate stage.

In one embodiment, the reforming catalyst within the penultimate and final stages is the same. In another embodiment, the reforming catalyst within the penultimate stage and final stage are different. In one embodiment the reforming catalyst of the penultimate stage and final stage comprises a Group VIII metal and a promoter supported on a porous refractory inorganic oxide support. In a preferred embodiment, the penultimate stage catalyst is platinum and rhenium on an alumina support. In another embodiment, the final stage catalyst is selected from the group consisting of a Group VIII metal, a molecular sieve, acid catalyst, clays and combinations thereof. In a preferred embodiment the reforming catalyst of the penultimate stage comprises a Group VIII metal and a promoter supported on a porous refractory inorganic oxide support and the reforming catalyst within the final stage comprises zeolite Beta.

In another embodiment, the process of the present invention comprises (1) contacting a naphtha boiling range feedstock in a penultimate stage of a multi-stage reforming process at a first reforming pressure with a first reforming catalyst to produce a penultimate effluent; (2) separating at least a portion of the penultimate effluent into at least a light reformate, an intermediate reformate and a heavy reformate, wherein the light reformate has a mid-boiling point that is lower than that of the intermediate reformate and wherein the light reformate comprises at least 70 vol % $C_5$ hydrocarbons, and wherein the intermediate reformate has a mid-boiling point that is lower than that of the heavy reformate and wherein the intermediate reformate comprises at least 70 vol % $C_6$-$C_8$ hydrocarbons; and (3) contacting the intermediate reformate in a final stage of the multi-stage reforming process at a second reforming pressure with a second reforming catalyst to produce a final effluent comprising a final reformate, wherein the final reformate has a higher RON than the intermediate reformate.

Other aspects, features and advantages will be apparent from the description of the embodiments thereof and from the claims.

DETAILED DESCRIPTION

Figure 1:
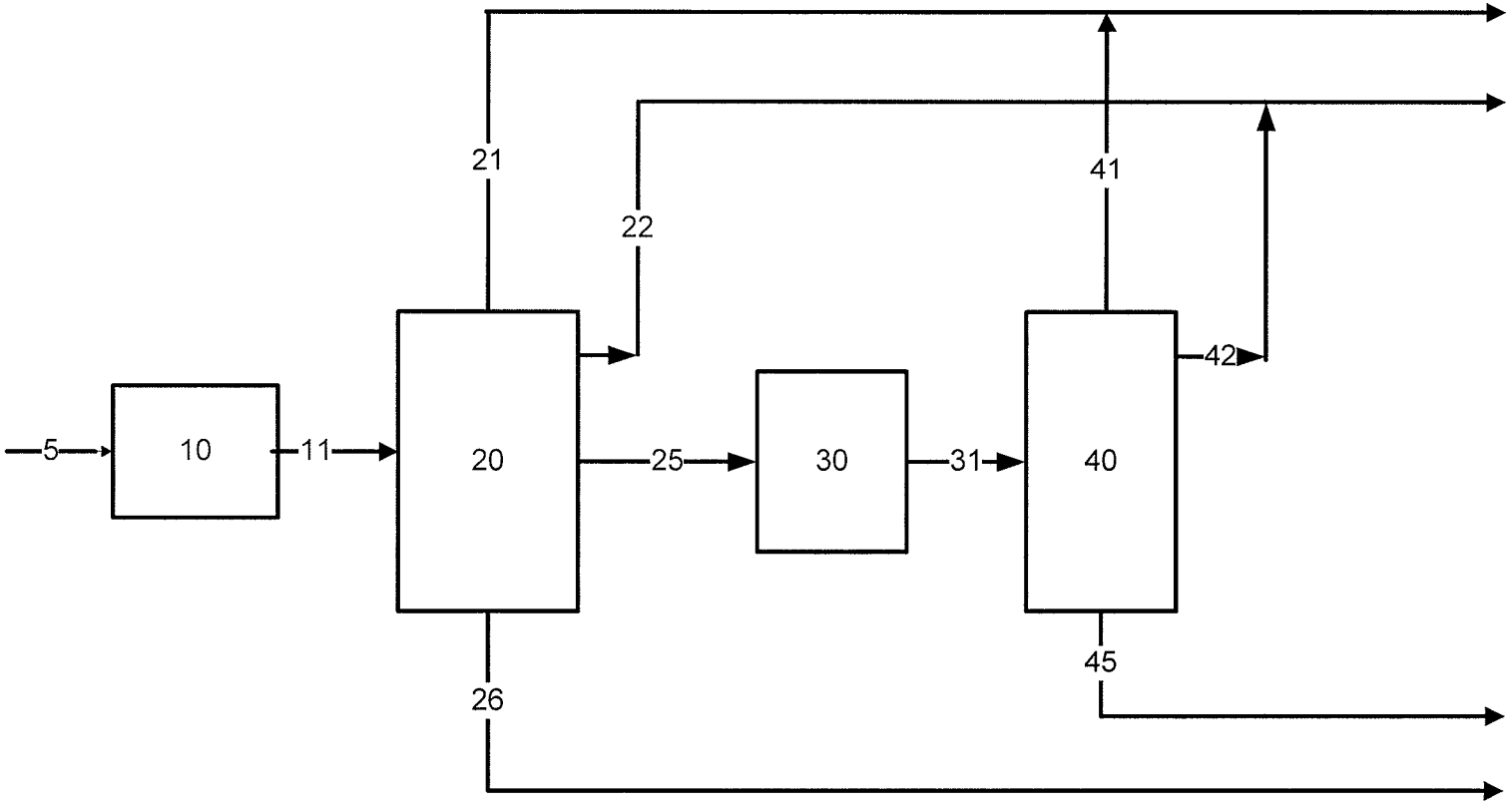
FIG. 1 is a schematic diagram of one embodiment of the invention.

In the present process, a naphtha boiling range feedstock is processed in a multi-stage reforming process, in which said process involves at least a penultimate stage for reforming the naphtha feedstock to produce a penultimate effluent and a final stage for further reforming a portion of the penultimate effluent. The reforming process is operated at conditions and with catalysts selected for conducting dehydrocyclization, isomerization and dehydrogenation reactions of paraffins thus converting low octane normal paraffins and cycloparaffins into high octane materials. In this way, a product having increased octane and/or containing an increased amount of aromatics is produced. In preferred embodiments, the multi-stage reforming process is operated at conditions and with one or more catalysts for producing a net positive quantity of hydrogen.

The multi-stage reforming process of the invention comprises passing a refinery stream through at least two reforming stages in series. In general, each reforming stage is characterized by one or more reforming reactor vessels, each containing a catalyst and maintained at reforming reaction conditions. The product from each stage before the final stage is passed, at least in part, to the succeeding stage in the multi-stage process. The temperature of the product from each stage which is passed to a succeeding stage may be increased or decreased to meet the particular needs of the process. Likewise, the pressure of the product which is passed to a succeeding stage before the final stage may be increased or decreased. Preferably the final stage is run at a lower pressure than the penultimate stage.

The present invention is based in part on the discovery that selective reforming of $C_5$-$C_8$ paraffins in a separate or additional reforming stage provides improved performance of the overall reforming process. Thus, a penultimate reforming stage using a conventional reforming catalyst is operated at relatively low severity, since it is not required to reach the high octane levels normally desired for a naphtha fuel or fuel blend stock. While not being bound to any theory, we believe that under these conditions the reforming catalyst of the penultimate stage catalyzes the more facile reactions, such as cyclohexane and alkycyclohexane dehydrogenation, while keeping hydrocracking to a minimum. Generally, a conventional catalyst used to dehydrocyclize paraffins under more severe conditions produces higher quantities of light $C_1$-$C_4$ gases, on account of the catalyst being somewhat unselective for dehydrocyclization. With the present invention, however, an intermediate reformate comprising at least 70 vol.% $C_5$-$C_8$ hydrocarbons from a penultimate reforming stage is passed to a final reforming stage containing the same or a different reforming catalyst as the penultimate stage. The $C_9$+ fraction from the penultimate stage has higher octane than the $C_5$-$C_8$ fraction, and is not further reformed in the final stage, thus preventing any unwanted dealkyation or cracking of the $C_9$+ hydrocarbons. In a preferred embodiment the final stage is run at a lower pressure than the penultimate stage. We believe that running the final stage at a lower pressure than the penultimate stage leads to improvements including one or more of the following characteristics—1) increased yield of $C_{5+}$ liquid products, 2) minimized unwanted hydrocracking/dealkylation reactions, and 3) increased hydrogen production. Lower pressure of the final stage can, in some cases, lead to higher catalyst fouling rates depending on the type of catalyst used; however, in situ catalyst regeneration of the final stage catalyst can be used to maintain catalyst activity. While the final stage catalyst is being regenerated, the severity of the penultimate stage can be temporarily increased to meet octane targets for the total blended reformate which would otherwise be achieved with both the penultimate and final stages operating. Consequently, the performance characteristics of the penultimate and final stage reactors provide complementary benefits, resulting in an overall process which produces a high octane product at an improved $C_{5+}$ liquid yield and improved hydrogen production.

While the discussion which follows relates at times, for convenience, to operation of penultimate and final reforming stages, the principles of the invention are applicable as between any two successive stages and can be applied to several sequentially connected stages. In essence then, the term final stage as used herein does not necessarily indicate the last stage if there are three or more stages, but rather indicates a succeeding stage which follows a preceding (often referred to for convenience as "penultimate") stage.

As disclosed herein, boiling point temperatures are based on ASTM D-2887 standard test method for boiling range distribution of petroleum fractions by gas chromatography, unless otherwise indicated. The mid-boiling point is defined as the 50% by volume boiling temperature, based on an ASTM D-2887 simulated distillation.

As disclosed herein, carbon number values (i.e. $C_5$, $C_6$, $C_8$, $C_9$ and the like) of hydrocarbons may be determined by standard gas chromatography methods.

As disclosed herein, Research Octane Number (RON) is determined using the method described in ASTM D2699.

Unless otherwise specified, as used herein, feed rate to a catalytic reaction zone is reported as the volume of feed per volume of catalyst per hour. The feed rate as disclosed herein is reported in reciprocal hours (i.e. $hr^{-1}$) which is also referred to as liquid hourly space velocity (LHSV).

As used herein, a $C_4$− stream comprises a high proportion of hydrocarbons with 4 or fewer carbon atoms per molecule. Likewise, a $C_5$+ stream comprises a high proportion of hydrocarbons with 5 or more carbon atoms per molecule. It will be recognized by those of skill in the art that hydrocarbon streams in refinery processes are generally separated by boiling range using a distillation process. As such, the $C_4$− stream would be expected to contain a small quantity of $C_5$, $C_6$ and even $C_7$ molecules. However, a typical distillation would be designed and operated such that at least about 70% by volume of a $C_4$− stream would contain molecules having 4 carbon atoms or fewer per molecule. Thus, at least about 70 vol % of a $C_4$− stream boils in the $C_4$− boiling range. As used herein, $C_5$+, $C_6$-$C_8$, $C_9$+ and other hydrocarbon fractions identified by carbon number ranges would be interpreted likewise.

The term "silica to alumina ratio" refers to the molar ratio of silicon oxide ($SiO_2$) to aluminum oxide ($Al_2O_3$).

As used herein the term "molecular sieve" refers to a crystalline material containing pores, cavities, or interstitial spaces of a uniform size in which molecules small enough to pass through the pores, cavities, or interstitial spaces are adsorbed while larger molecules are not. Examples of molecular sieves include zeolites and non-zeolitic molecular sieves such as zeolite analogs including, but not limited to, SAPOs (silicoaluminophosphates), MeAPOs (metalloaluminophosphates), $AlPO_4$, and ELAPOs (nonmetal substituted aluminophosphate families).

When used in this disclosure, the Periodic Table of the Elements referred to is the CAS version published by the Chemical Abstract Service in the Handbook of Chemistry and Physics, 72$^{nd}$ edition (1991-1992).

The naphtha boiling range feed entering the penultimate stage of the multi-stage process is a naphtha fraction boiling within the range of 50° to 550° F., preferably from 70° to 450° F., more preferably from 80° to 400° F., and most preferably from 90° to 360° F. In one embodiment, the naphtha feed is a $C_5$+ feed. In another embodiment at least 85 vol % of the naphtha feedstock boils from about 70° to 450° F. The naphtha feed can include, for example, straight run naphthas, paraffinic raffinates from aromatic extraction or adsorption, $C_6$-$C_{10}$ paraffin-rich feeds, bioderived naphtha, naphtha from hydrocarbon synthesis processes, including Fischer Tropsch and methanol synthesis processes, as well as naphtha products from other refinery processes, such as hydrocracking or conventional reforming. In reforming processes involving more than two stages, the reformer feed may comprise at least a portion of the product generated in a preceding stage.

The reforming catalyst used in the penultimate reforming stage may be any catalyst known to have catalytic reforming activity. In one embodiment, the penultimate stage catalyst comprises a Group VIII metal disposed on an oxide support. Examples of Group VIII metals include platinum and palladium. The catalyst may further comprise a promoter, such as rhenium, tin, tungsten, germanium, cobalt, nickel, iridium, rhodium, ruthenium, or combinations thereof. In some such embodiments, the promoter metal is rhenium or tin.

The above mentioned metals can be disposed on a support comprising one or more of (1) a refractory inorganic oxide such as alumina, silica, titania, magnesia, zirconia, chromia, thoria, boria or mixtures thereof (2) a synthetically prepared or naturally occurring clay or silicate, which may be acid-treated; (3) a crystalline zeolitic aluminosilicate, either naturally occurring or synthetically prepared such as FAU, MEL, MFI, MOR, MTW (IUPAC Commission on Zeolite Nomenclature), in hydrogen form or in a form which has been exchanged with metal cations; (4) a spinel such as $MgAl_2O_4$, $FeAl_2O_4$, $ZnAl_2O_4$, $CaAl_2O_4$; (5) a silicoaluminophosphate; and (6) combinations of materials from one or more of these groups. The refractory support of the reforming catalyst preferably comprises an inorganic oxide, more preferably alumina.

Halogen may be incorporated into the catalyst by combining it with a source of halogen such as alkali or alkaline earth chlorides, fluorides, iodides or bromides. Other halogen sources include compounds such as hydrogen halide, e.g., hydrogen chloride, and ammonium halides, e.g., ammonium chloride. The preferred halogen source is a source of chlorine. The amount of halogen source combined with the catalyst should be such that the catalyst contains from about 0.1 to 3 wt % halogen, more preferably from about 0.2 to about 1.5 wt % halogen, and most preferably between 0.5 to 1.5 wt % halogen.

The catalyst, if it includes a promoter metal, suitably includes sufficient promoter metal to provide a promoter to platinum ratio between 0.5:1 and 10:1, more preferably between 1:1 and 6:1, most preferably between 2:1 and 5:1. The precise conditions, compounds, and procedures for catalyst manufacture are known to those persons skilled in the art. Some examples of conventional catalysts are shown in U.S. Pat. Nos. 3,631,216; 3,415,737; and 4,511,746, which are hereby incorporated by reference in their entireties.

The reforming catalyst in the penultimate stage and final stage may be employed in the form of pills, pellets, granules, broken fragments, or various special shapes, disposed as a fixed bed within a reaction zone, and the charging stock may be passed through in the liquid, vapor, or mixed phase, and in either upward, downward or radial flow. Alternatively, the reforming catalysts can be used in moving beds or in fluidized-solid processes, in which the charging stock is passed upward through a turbulent bed of finely divided catalyst. However, a fixed bed system or a dense-phase moving bed system are preferred due to less catalyst attrition and other operational advantages. In a fixed bed system, the feed is preheated (by any suitable heating means) to the desired reaction temperature and then passed into a reaction zone containing a fixed bed of the catalyst. This reaction zone may be one or more separate reactors with suitable means to maintain the desired temperature at the reactor entrance. The temperature must be maintained because reforming reactions are typically endothermic in nature.

The actual reforming conditions in the penultimate stage will depend, at least in part, on the feed used, whether highly aromatic, paraffinic or naphthenic and upon the desired octane rating of the product and the desired hydrogen production.

The penultimate stage is maintained at relatively mild reaction conditions, so as to inhibit the cracking of the stream being upgraded, and to increase the useful lifetime of the catalyst in the penultimate stage. The naphtha boiling range feedstock to be upgraded in the penultimate stage contacts the penultimate stage catalyst at reaction conditions, which conditions include a temperature in the range from about 800° F. to about 1100° F., a pressure in the range from about 70 psig to about 400 psig, and a feed rate in the range of from about 0.5 LHSV to about 5 LHSV. In some embodiments, the pressure in the penultimate stage is in the range from about 200 psig to about 400 psig.

The effluent from the penultimate stage is an upgraded product, in that the RON has been increased during reaction in the penultimate stage as compared to the RON of the naphtha feedstock. The penultimate stage effluent comprises hydrocarbons and hydrogen generated during reaction in the penultimate stage and at least some of the hydrogen, if any, which is added to the feed upstream of the penultimate stage. The effluent hydrocarbons may be characterized as a mixture of $C_4$− hydrocarbons and $C_5$+ hydrocarbons, the distinction relating to the molecular weight of the hydrocarbons in each group. In embodiments, the $C_5$+ hydrocarbons in the effluent have a combined RON of at least 85.

The effluent from the penultimate stage (otherwise termed the "penultimate effluent") comprises $C_5$+ hydrocarbons which are separated into at least an intermediate reformate and a heavy reformate. The effluent further comprises hydrogen and $C_4$− hydrocarbons. In some embodiments, a hydrogen-rich stream is separated from the effluent in a preliminary separation step, using, for example, a high pressure separator or other flash zone. $C_4$− hydrocarbons in the effluent may also be separated in a preliminary separation, either along with the hydrogen or in a subsequent flash zone. The intermediate reformate is characterized as having a lower mid-boiling point than that of the heavy reformate. In some embodiments, the intermediate reformate boils in the range from about 70° F. to about 280° F. In some such embodiments, the intermediate reformate comprises at least 70 vol % $C_5$-$C_8$ hydrocarbons. In some embodiments, the intermediate reformate boils in the range from about 100° F. to about 280° F. In some such embodiments, the intermediate reformate comprises at least 70 vol % $C_6$-$C_8$ hydrocarbons. In some embodiments, the intermediate reformate boils in the range from about 100° F. to about 230° F. In some such embodiments, the intermediate reformate comprises at least 70 vol % $C_6$-$C_7$ hydrocarbons. Recovery of an intermediate reformate fraction may be accompanied by the further recovery of a largely $C_5$ light reformate fraction. The light reformate is characterized as having a lower mid-boiling point than that of the intermediate reformate. In some embodiments, the light reformate fraction boils in the range from about 70° F. to about 140° F. In some such embodiments, the light reformate fraction comprises at least 70 vol % $C_5$ hydrocarbons. The heavy reformate that is produced during separation of the upgraded product boils in the range of about 220° F. and higher. In some such embodiments, the heavy reformate comprises at least 70 vol % $C_9$+ hydrocarbons.

The RON of the intermediate reformate is indicative of the mild reforming conditions in the penultimate stage. As such, the intermediate reformate typically has an RON within the range of about 65 to 90. In one embodiment the intermediate reformate has a RON of about 70 to about 90. In a further embodiment the intermediate reformate has an RON within the range of about 70 to about 85.

The reforming catalyst used in the final stage may be any catalyst known to have catalytic reforming activity. Catalysts described above for the penultimate stage can be used in the final stage. Examples of catalysts useful in the final stage include: (1) molecular sieves such as zeolites, borosilicates, and silicoaluminophosphates; (2) amorphous Group VIII metal catalysts with an optional promoter metal selected from the group consisting of a non-platinum Group VIII metal, e.g. rhenium, germanium, tin, lead, gallium, indium, and mixtures thereof; and (3) additional catalysts comprising acid catalysts and clays. The final stage catalyst may include a single catalyst or a mixture of more than one of the above catalysts. In an embodiment the final stage catalyst comprises a zeolite and a group VIII metal. In another embodiment the final stage catalyst is a platinum rhenium catalyst supported on alumina.

Molecular sieves particularly useful in the practice of the present invention include zeolites, zeolite analogs, and nonzeolitic molecular sieves. By "zeolite analog" it is meant that a portion of the silicon and/or aluminum atoms in the zeolite are replaced with other tetrahedrally coordinated atoms such as germanium, boron, titanium, phosphorus, gallium, zinc, iron, or mixtures thereof. The term "nonzeolitic molecular sieve" as used herein refers to molecular sieves whose frameworks are not formed of substantially only silicon and aluminum atoms in tetrahedral coordination with oxygen atoms. Zeolites, zeolite analogs, and nonzeolitic molecular sieves can be broadly described as crystalline microporous molecular sieves that possess three-dimensional frameworks composed of tetrahedral units ($TO_{4/2}$, T=Si, Al, or other tetrahedrally coordinated atom) linked through oxygen atoms. Depending on the identity of the T atoms in the zeolite, zeolite analog, or nonzeolitic molecular sieve the properties of the material are affected. For example, the presence of aluminum in a zeolite introduces a negative charge in the zeolite framework and affects the acidity and activity of the zeolite as a reforming catalyst. The Si/Al ratio in zeolites can vary from about 1 to infinity. The lower limit arises from the avoidance of neighboring tetrahedral units with negative charges ($Al^-$—O—$Al^-$). It is generally accepted that the linking of two $AlO_4$ tetrahedra is energetically unfavorable enough to preclude such occurrences. Negative charges in a zeolite, zeolite analog, or nonzeolitic molecular sieve framework are compensated by extraframework cations such as protons and alkali cations. The properties of zeolites, zeolite analog, or nonzeolitic molecular sieve can be altered through exchange of these extraframework cations with other positively charged species. The type of cations present in the zeolite, zeolite analog, or nonzeolitic molecular sieve framework help determine the acidity of the molecular sieve.

Strong acidity in the molecular sieve can be undesirable for catalytic reforming because it promotes cracking, resulting in lower selectivity. To reduce acidity, the molecular sieve preferably contains an alkali metal and/or an alkaline earth metal. The alkali or alkaline earth metals are preferably incorporated into the catalyst during or after synthesis of the molecular sieve. Preferably, at least 90% of the acid sites are neutralized by introduction of the metals, more preferably at least 95%, most preferably at least 99%. In one embodiment, the intermediate pore molecular sieve has less than 5,000 ppm alkali. Such intermediate pore silicate molecular sieves are disclosed, for example, in U.S. Pat. No. 4,061,724 and in U.S. Pat. No. 5,182,012. These patents are incorporated herein by reference, particularly with respect to the description, preparation and analysis of silicates having a specified silica to alumina molar ratio, having a specified crystallite size, having a specified crystallinity, and having a specified alkali content.

Prior art techniques have resulted in the formation of a great variety of synthetic zeolites. Many of the zeolites have come to be designated by letter or other convenient symbol, as illustrated by zeolite Z (U.S. Pat. No. 2,882,243); zeolite X (U.S. Pat. No. 2,882,244); zeolite Y (U.S. Pat. No. 3,130,007); zeolite ZK-5 (U.S. Pat. No. 3,247,195); zeolite ZK-4 (U.S. Pat. No. 3,314,752); zeolite ZSM-5 (U.S. Pat. No. 3,702,886); zeolite ZSM-11 (U.S. Pat. No. 3,709,979); zeolite ZSM-12 (U.S. Pat. No. 3,832,449); zeolite ZSM-20 (U.S. Pat. No. 3,972,983); zeolite ZSM-35 (U.S. Pat. No. 4,016,245); and zeolite ZSM-23 (U.S. Pat. No. 4,076,842). Zeolite Beta is described in U.S. Pat. No. 3,308,069 and RE 28,341 both to Wadlinger, and reference is made to these patents for a general description of zeolite Beta. The zeolite Beta of Wadlinger is described as having a silica-to-alumina ratio going from 10 to 100 and possibly as high as 150. Highly silicious zeolite Beta described as having silica-to-alumina ratios within the range of 20-1000 is disclosed in Valyocsik et al, U.S. Pat. No. 4,923,690.

In addition to cation-exchange, the catalytic properties of the zeolitic molecular sieve can be altered by isomorphous substitution of at least some of the tetrahedral atoms to make zeolite analogs or nonzeolitic molecular sieves wherein a portion or all of the silicon or aluminum atoms of the zeolite framework are replaced with, for example, germanium, titanium, boron, phosphorus, gallium, iron, or zinc. The use of these different elements in zeolite synthesis has often led to materials with novel topologies or to materials with properties that are very different from their aluminosilicate (zeolite) counterparts which have equivalent framework topologies. For example, the aluminosilicate zeolite RHO cannot currently be synthesized with a Si/Al ratio much below 3. However, the aluminogermanate and gallosilicate analogues of zeolite RHO can be made with a Ge/Al ratio and a Si/Ga ratio of 1.0 and 1.3 respectively. The cation-exchange capacities of these RHO materials are therefore very different. Aluminophosphate and gallophosphate analogues of zeolites are other example of molecular sieves based on replacement of silicon with other atoms. These materials are usually composed of strictly alternating $AlO_4$ (or $GaO_4$) and $PO_4$ tetrahedral units, but they can be altered by isomorphous substitution of silicon, magnesium, beryllium, or transition metal ions.

Molecular sieves have uniformly sized pores (3 to 10 Å) which are determined by their unique crystal structures. The pores in zeolites and zeolite analogs are often classified as small (8 T atoms), medium (10 T atoms), large (12 T atoms), or extra-large (≥14 T atoms) according to the number of tetrahedral atoms that surround the pore apertures. Zeolite A (LTA) and zeolite Rho are examples of molecular sieves with small pores delimited by 8-membered rings, wherein the pore aperture measures about 4.1 Å, while zeolite X (FAU) and zeolite Beta are examples of zeolites with large pores delimited by 12-membered rings wherein the pore aperture measures about 7.4 Å. While the final stage catalyst can comprise large pore molecular sieves such as zeolite X, in a preferred embodiment the final stage catalyst comprises a medium pore molecular sieve. The phrase "medium pore" as used herein means having a crystallographic free diameter in the range of from about 3.9 to about 7.1 Angstrom when the molecular sieve is in the calcined form. Shape selective medium pore molecular sieves used in some embodiments of the practice of the present invention have generally 1-, 2-, or 3-dimensional channel structures, with the pores characterized as being 9 or 10-ring structures. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10[ndash]15, which is incorporated herein by reference.

Non-limiting examples of medium pore molecular sieves include ZSM-5, ZSM-11, ZSM-22, ZSM-23, ZSM-35, ZSM-38, ZSM-48, ZSM-57, MCM-22, SSZ-20, SSZ-25, SSZ-32, SSZ-35, SSZ-37, SSZ-44, SSZ-45, SSZ-47, SSZ-57, SSZ-58, SSZ-74, SUZ-4, EU-1, NU-85, NU-87, NU-88, IM-5, TNU-9, ESR-10, TNU-10 and combinations thereof.

The crystallite size of the molecular sieve can vary depending on preparation conditions and may be tuned depending on the desired product and reactor conditions in the final stage of the reforming process. By way of illustration only, in the medium pore zeolite ZSM-5, manipulating crystal size in order to change the selectivity of the catalyst has been described in U.S. Pat. No. 4,517,402 which is incorporated herein by reference. Additional references disclosing ZSM-5 are provided in U.S. Pat. No. 4,401,555 to Miller, hereby incorporated by reference in its entirety and in U.S. Pat. No. 5,407,558. In one embodiment, the final stage catalyst is a high silica to alumina ZSM-5 having a silica to alumina molar ratio of at least 40:1, preferably at least 200:1 and more preferably at least 500:1. In an embodiment the final stage catalyst is high silica to alumina ZSM-5 with a small crystallite size wherein the crystallite size less than 10 microns, more preferably less than 5 microns, and most preferably less than 1 micron.

Other molecular sieves which can be used in the final reforming stage include those as listed in U.S. Pat. No. 4,835,336; namely: ZSM-11, ZSM-12, ZSM-22, ZSM-23, ZSM-35, ZSM-38, ZSM-48, and other similar materials such as CZH-5 disclosed in Ser. No. 166,863 of Hickson, filed Jul. 7, 1980 and incorporated herein by reference.

SSZ-20 is disclosed in U.S. Pat. No. 4,483,835, and SSZ-23 is disclosed in U.S. Pat. No. 4,859,442, both of which are incorporated herein by reference.

ZSM-5 is more particularly described in U.S. Pat. No. 3,702,886 and U.S. Pat. Re. 29,948, the entire contents of which are incorporated herein by reference.

ZSM-11 is more particularly described in U.S. Pat. No. 3,709,979 the entire contents of which are incorporated herein by reference.

ZSM-12 is more particularly described in U.S. Pat. No. 3,832,449, the entire contents of which are incorporated herein by reference.

ZSM-22 is more particularly described in U.S. Pat. Nos. 4,481,177, 4,556,477 and European Pat. No. 102,716, the entire contents of each being expressly incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

ZSM-48 is more particularly described in U.S. Pat. No. 4,397,827 the entire contents of which are incorporated herein by reference.

Other zeolites useful in the practice of the present invention include, but are not limited to: Y zeolite, mordenite, offretite, omega, ferrierite, heulandite, SSZ-24, SSZ-25, SSZ-26, SSZ-31, SSZ-32, SSZ-33, SSZ-35, SSZ-37, SSZ-42, SSZ-44, EU-1, NU-86, NU-87, UTD-1, MCM-22, MCM-36, MCM-56, and mixtures thereof.

Examples of zeolite analogs useful in the process of the invention include borosilicates, where boron replaces at least a portion of the aluminum of the zeolitic form of the material. Examples of borosilicates are described in U.S. Pat. Nos. 4,268,420; 4,269,813; 4,327,236 to Klotz, the disclosures of which patents are incorporated herein.

Silicoaluminophosphates (SAPOs) are an example of nonzeolitic molecular sieves useful in the practice of the present invention. SAPOs comprise a molecular framework of corner-sharing [SiO4] tetrahedra, [A104] tetrahedra and [PO4] tetrahedra linked by oxygen atoms. By varying the ratio of P/Al and Si/Al the acidity of the SAPO can be modified to minimize unwanted hydrocracking and maximize advantageous isomerization reactions. Preferred molar ratios of P/Al are from about 0.75 to 1.3 and preferred molar ratios of Si/Al are from about 0.08 to 0.5. Examples of a silcoaluminophosphate useful to the present invention include SAPO-11, SAPO-31, and SAPO-41, which are also disclosed in detail in U.S. Pat. No. 5,135,638.

The molecular sieves optionally include an amorphous support or binder such as amorphous alumina or amorphous silica. Other examples of amorphous supports are selected from the group consisting of alumina, silica, titania, vanadia, chromia, zirconia, and mixtures thereof. Other supports such as naturally occurring or synthetic clays including, but not limited to, bentonite, kaolin, sepiolite, attapulgite, and hallyosite can be used in the process of this invention. The support may make up to 80% by weight of the catalyst.

The molecular sieve catalysts according to the present invention may also contain one or more Group VIII metals, e.g., nickel, ruthenium, rhodium, palladium, iridium or platinum. The preferred Group VIII metals are iridium, palladium, and platinum. Most preferred is platinum due to its high selectivity with regard to dehydrocyclization and stability under the dehydrocyclization reaction conditions. The preferred percentage of the Group VIII metals, such as platinum, in the catalyst is between 0.1 wt. % and 5 wt. %, more preferably from 0.3 wt. % to 2.5 wt. %.

Examples of amorphous Group VIII metal catalysts include those detailed in "penultimate zone catalyst" above. Suitable catalysts for the final stage include platinum-containing amorphous reforming catalysts which optionally contain a promoter metal selected from the group consisting of a non-platinum Group VIII metal, e.g. rhenium, germanium, tin, lead, gallium, indium, and mixtures thereof. The platinum may exist within the catalyst as a compound such as the oxide, sulfide, halide, oxyhalide, in chemical combination with one or more other ingredients of the catalytic composite, or as an elemental metal. Preferably, substantially all of the platinum exists in the catalytic composite in a reduced state. The preferred platinum component generally comprises from about 0.01 wt. % to 2 wt. % of the catalytic composite, preferably 0.05 to 1 wt. %, calculated on an elemental basis.

The catalyst can also include a binder material. Binders include inorganic oxide supports such as alumina, silica, silica-alumina, titania, vanadia, chromia, zirconia, clays, zeolites, non-zeolitic molecular sieves, and mixtures thereof. The binder may make up to 80% by weight of the catalyst.

Any conventional impregnation, mulling, ion exchange or other known methods for adding the metals to the binder may be used. The Group VIII noble metals may be introduced into the amorphous binder by, for example, ion exchange, impregnation, carbonyl decomposition, adsorption from the gaseous phase, introduction during synthesis, and adsorption of metal vapor. The preferred technique is ion exchange or impregnation by the so-called incipient witness method. Preparations of such catalysts are taught, e.g., in U.S. Pat. Nos. 3,415,737; 4,636,298; and 4,645,586, the disclosures of which are incorporated herein by references.

The catalyst optionally contains a halogen component. The halogen component may be either fluorine, chlorine, bromine, iodine or mixtures thereof. Chlorine is the preferred halogen component. The halogen component is generally present in a combined state with the inorganic-oxide support. The halogen component is preferably well dispersed throughout the catalyst and may comprise from more than 0.2 wt. % to about 15 wt. %, calculated on an elemental basis, of the final catalyst.

Conventional acid catalysts such as solid acid catalyst including, but not limited to, acidic clays and acidic zeolites may also be used in the practice of the present invention as a final stage catalyst or as a component of the final stage catalyst. The zeolite molecular sieves discussed above with protons as counterions in the anionic zeolite framework are examples of solid acid catalysts. MCM-22 is an example of a layered aluminosilicate clay which can act as a solid acid.

The final stage catalyst may comprise acidic or non acidic phyllosilicate clay compositions derived from the smectites such as those described in U.S. Pat. Nos. 4,248,739 and 5,414,185. Final stage catalysts may comprise any natural or synthetic clays having a lamellar structure, examples of which include, but are not limited to, bentonite, montmorillonite, berdellite, hectorite, vermiculite and the like. Layered clays can be delaminated or pillared to produce high surface area materials with a majority of their active sites or cations exposed at the crystal surface.

The clays may further comprise active metals such as Group VIII metals, preferably platinum or palladium. The clays mentioned above may be used alone or admixed with inorganic oxide matrix components such as silica, alumina, silica-alumina, hydrogels and other clays. The clays may be any suitable size or shape as to ensure good contact with the reactants. Examples include powder, pellets, granules, extrudates, and spheres.

Reaction conditions in the final reforming stage are specified to effectively utilize the particular performance advantages of the catalyst used in the stage. Preferably the reaction pressure of the final reforming stage is less than the pressure in the penultimate stage. Low pressure in the final stage may lead to increased catalyst fouling. However, as the process of the invention requires at least two stages—a penultimate and a final stage—catalyst regeneration in the final stage reactor can occur as needed to maintain high catalyst activity in the final stage. For example, as naphtha reforming is taking place in the penultimate reactor, catalyst regeneration can take place in the final reactor. While the final stage catalyst is being regenerated, the severity of the penultimate stage can be temporarily increased to meet RON targets for the total blended reformate which would otherwise be achieved with both the penultimate and final stages in operation. Operating the final reforming stage at a lower relative pressure than the penultimate stage minimizes the formation of light ($C_{4-}$) products while increasing the yield of high octane naphtha and overall liquid yield in the two stage process of the invention. Because the penultimate stage is operated at relatively mild conditions, catalyst life in that stage is lengthened while giving good yields of desired high octane products.

The naphtha feed to the final stage is the intermediate reformate which is separated from the effluent of the penultimate stage. In the process, the intermediate reformate contacts the catalyst in the final stage at reforming reaction conditions, which reaction conditions include a temperature in the range from about 800° F. to about 1100° F., a pressure in the range from about 40 psig to about 400 psig and a feed rate in the range of from about 0.5 LHSV to about 5 LHSV. In some embodiments, the pressure in the final reforming stage is less than 100 psig. Preferably the pressure in the final reforming stage is from about 40 psig to about 200 psig, and more preferably from about 40 psig to about 100 psig. Hydrogen is preferably added as an additional feed to the final reforming stage, but it is not required. In embodiments, hydrogen added with the feed is recovered from the process and is recycled to the final stage.

Depending on the particular process, the effluent from the final reforming stage may contain light (i.e. $C_4-$ products and/or hydrogen) products which may be removed from the reformate prior to further processing or blending to make a fuel product. The $C_5+$ reformate, herein referred to as the final reformate, which is produced in the final reforming stage has an increased RON relative to that of the intermediate reformate which is the feed to the final reforming stage. Preferably, at least 75 vol % of the final reformate boils in the $C_5+$ range. The final reformate may be used as a fuel or a fuel component by blending with other hydrocarbons. In embodiments, the RON of the final reformate is 80 or higher, preferably 90 or higher, and most preferably 95 or higher.

The reformate is useful as a fuel or as a blend stock for a fuel. In some embodiments, at least a portion of the reformate from the final reforming stage is blended with at least a portion of the heavy reformate, which is recovered from the penultimate reforming stage; the blend may be used as a fuel or as a blend stock for a fuel.

Depending on the particular process, the effluent (otherwise termed the "final effluent") from the final reforming stage may contain light (i.e. $C_4$− products and/or hydrogen) products which may be removed from the reformate in a final separation step prior to further processing for blending or use as a fuel. A hydrogen-rich stream may be separated from the effluent prior to the separation step, using, for example, a high pressure separator or other flash zone. $C_4$− hydrocarbons in the effluent may also be separated in a preliminary flash zone, either along with the hydrogen or in a subsequent flash zone. The reformate which is produced in the final reforming stage has an increased RON relative to that of the intermediate reformate which is the feed to the final reforming stage. In embodiments, the RON of the final reformate is at least 90 or at least 95, or at least 98. In some embodiments, the final reformate boils in the range from about 70° F. to about 280° F. In some such embodiments, the final reformate comprises at least 70 vol % $C_5$-$C_8$ hydrocarbons. In some embodiments, the final reformate boils in the range from about 100° F. to about 280° F. In some such embodiments, the final reformate comprises at least 70 vol % $C_6$-$C_8$ hydrocarbons. In some embodiments, the final reformate boils in the range from about 100° F. to about 230° F. In some such embodiments, the final reformate comprises at least 70 vol % $C_6$-$C_7$ hydrocarbons. In addition to the final reformate stream, a final light stream may also be recovered from the final effluent. In such cases, the final light stream boils in the range of about 70° to about 140° F. In some such embodiments, the final light stream comprises at least 70 vol % $C_5$ hydrocarbons.

The reformate is useful as a fuel or as a blend stock for a fuel. In some embodiments, at least a portion of the reformate from the final reforming stage is blended with at least a portion of the heavy reformate, which is recovered from the penultimate reforming stage; the blend may be used as a fuel or as a blend stock for a fuel.

Reference is now made to an embodiment of the invention illustrated in FIG. 1. A naphtha boiling range fraction 5 which boils within the range of 50° F. to 550° F. passes into the reaction stage 10 at a feed rate in the range of about 0.5 $hr^{-1}$ to about 5 $hr^{-1}$ LHSV. Reaction conditions in the reforming stage 10 include a temperature in the range from about 800° F. to about 1100° F. and a total pressure in the range of greater than 70 psig to about 400 psig.

The effluent 11 from the penultimate stage is an upgraded product, in that the RON has been increased during reaction in the penultimate stage 10. The penultimate stage effluent 11 comprises hydrocarbons and hydrogen generated during reaction in the penultimate stage and at least some of the hydrogen (if any) added to the feed upstream of the penultimate stage. In the embodiment illustrated in FIG. 1, the effluent is separated in separation zone 20 into a hydrogen-rich stream 21, a $C_4$− stream 22, an intermediate reformate 25 and a heavy reformate 26. In embodiments, this separation occurs in a single separation zone. In other embodiments, this separation is done in sequential zones, with the hydrogen, and optionally the $C_4$− stream, separated in one or more preliminary separation zones prior to the separation of the intermediate reformate 25 and the heavy reformate 26.

In the embodiment illustrated in FIG. 1, the intermediate reformate 25 comprises a substantial amount of the $C_5$-$C_8$ hydrocarbons contained in the effluent, with smaller quantities of $C_4$ and $C_9$ hydrocarbons. At least a portion of intermediate reformate 25 is passed to final reforming stage 30. Heavy reformate 26 contains a substantial amount of the $C_9$+ hydrocarbons contained in the effluent 11, and has an RON of greater than 98, preferably greater than 100.

Intermediate reformate 25 is passed to final reforming stage 30 for contact with a catalyst comprising platinum and at least one medium pore molecular sieve, at reaction conditions which include a temperature in the range from about 800° F. to about 1100° F. and a pressure in the range from about 50 psig to about 250 psig.

Effluent 31 from the final reforming stage is separated in separation zone 40, yielding at least a hydrogen-rich stream 41, a $C_4$− stream 42, and a final reformate stream 45. In embodiments, the final reformate stream boils in the $C_5$+ boiling range. As described above, this separation may take place in one, or multiple, separation zones, depending on the specific requirements of a particular process. In an embodiment, the final reformate stream 45 may be further combined with the heavy reformate 26 before further processing or use as a fuel or fuel blend stock. Hydrogen-rich stream 41 is combined with hydrogen-rich stream 21 before using in other refinery processes, and $C_4$− stream 42 is combined with $C_4$− stream 22.

Figure 2:
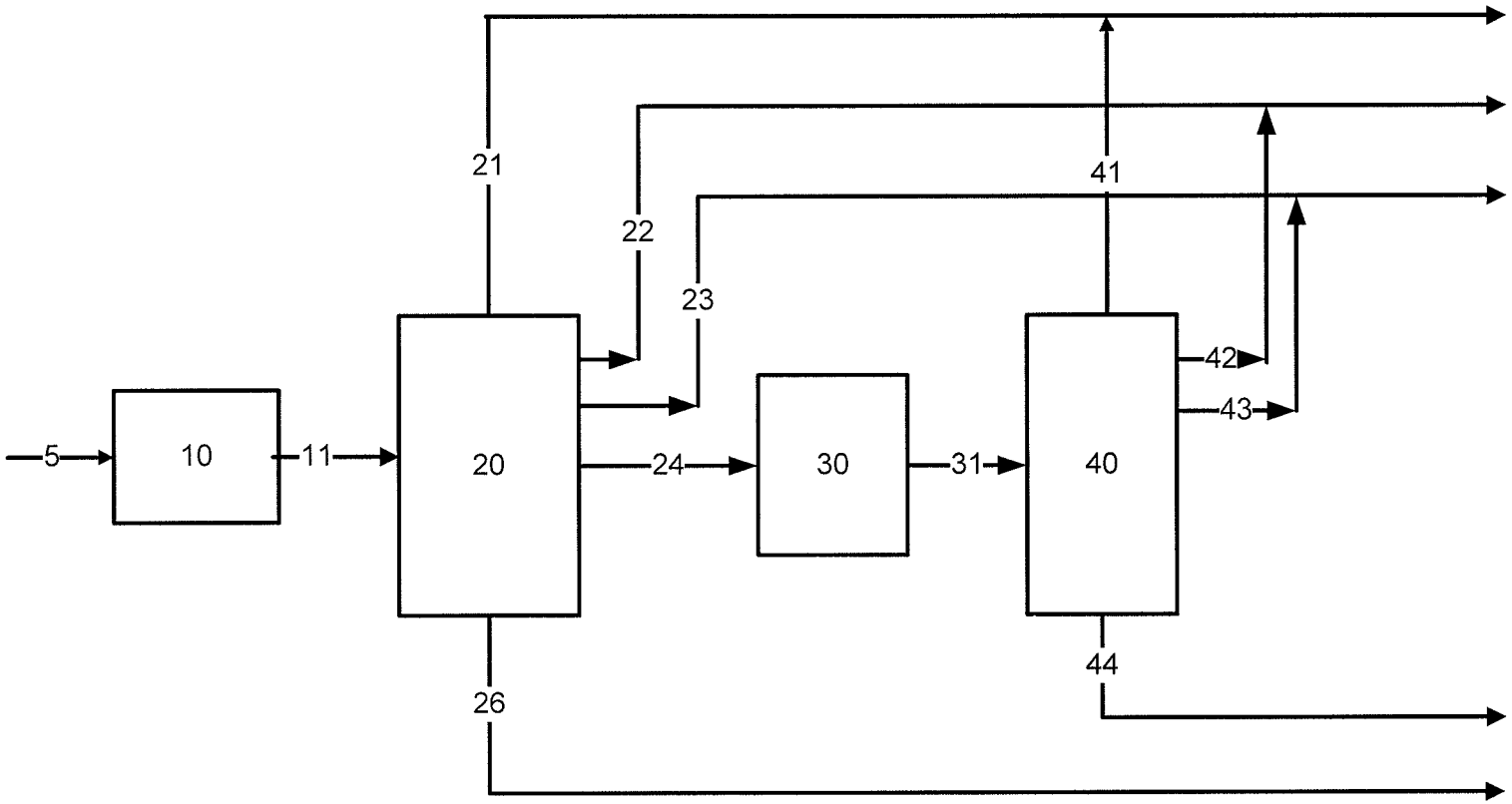
FIG. 2 is a schematic diagram of a second embodiment of the invention.

Reference is now made to an embodiment of the invention illustrated in FIG. 2. A naphtha boiling range fraction 5 which boils within the range of 50° F.° to 550° F. passes into the reaction stage 10 at a feed rate in the range of about 0.5 $hr^{-1}$ to about 5 $hr^{-1}$ LHSV. Reaction conditions in the reforming stage 10 include a temperature in the range from about 800° F. to about 1100° F. and a total pressure in the range of greater than 70 psig to about 400 psig.

The effluent 11 from the penultimate stage is an upgraded product, in that the RON has been increased during reaction in the penultimate stage 10. The penultimate stage effluent 11 comprises hydrocarbons and hydrogen generated during reaction in the penultimate stage and at least some of the hydrogen (if any) added to the feed upstream of the penultimate stage. In the embodiment illustrated in FIG. 2, the effluent is separated in separation zone 20 into a hydrogen-rich stream 21, a $C_4$− stream 22, a light reformate 23, an intermediate reformate 24 and a heavy reformate 26. In embodiments, this separation occurs in a single separation zone. In other embodiments, this separation is done in sequential zones, with the hydrogen, and optionally the $C_4$− stream, separated in one or more preliminary separation zones prior to the separation of the light reformate 23, the intermediate reformate 24 and the heavy reformate 26.

In the embodiment illustrated in FIG. 2, the light reformate 23 comprises a substantial amount of the $C_5$ hydrocarbons contained in the effluent, with smaller quantities of $C_4$ and $C_6$ hydrocarbons. The intermediate stream comprises a substantial portion of the $C_6$-$C_8$ hydrocarbons contained in the effluent; the heavy reformate 26 contains a substantial amount of the $C_9$+ hydrocarbons contained in the effluent 11.

Intermediate reformate 24 is passed to final reforming stage 30 at a feed rate in the range of from about 0.5 $hr^{-1}$ to about 5 $hr^{-1}$ LHSV, for contact with a catalyst comprising platinum and at least one medium pore molecular sieve, at reaction conditions which include a temperature in the range from about 800° F. to about 1100° F. and a pressure in the range from about 50 psig to about 250 psig.

Effluent 31 from the final reforming stage is separated in separation zone 40, yielding at least a hydrogen-rich stream 41, a $C_4$− stream 42, a final $C_5$ stream 43 and a final reformate stream 44. In embodiments, the final reformate stream boils in the $C_6$+ boiling range. As described above, this separation may take place in one, or multiple, separation zones, depending on the specific requirements of a particular process. As shown in the embodiment illustrated in FIG. 2, the final reformate stream 44 is further combined with the heavy reformate 26 before further processing or use as a fuel or fuel blend stock, hydrogen-rich stream 41 is combined with hydrogen-rich stream 21 before using in other refinery processes, $C_4$− stream 42 is combined with $C_4$− stream 22 and final $C_5$ stream 43 is combined with $C_5$ stream 23.

The following examples are presented to exemplify embodiments of the invention but are not intended to limit the invention to the specific embodiments set forth. Unless indicated to the contrary, all parts and percentages are by weight. All numerical values are approximate. When numerical ranges are given, it should be understood that embodiments outside the stated ranges may still fall within the scope of the invention. Specific details described in each example should not be construed as necessary features of the invention.

Examples

In the following examples, the RON values are calculated values, based on RON blending correlations applied to a composition analysis using gas chromatography. The method was calibrated to achieve a difference between measured RON values, determined by ASTM D2699, and calculated RON values of within ±0.8.

Example 1

A naphtha feed, with an API of 54.8, RON of 53.3 and an ASTM D-2887 simulated distillation shown in Table 1 was reformed in a penultimate stage using a commercial reforming catalyst comprising platinum with a rhenium promoter on an alumina support. The catalyst contained about 0.3 wt. % platinum, and about 0.6 wt. % rhenium on an extruded alumina support. Reaction conditions included a temperature of 840° F., a pressure of 200 psig, a 5:1 molar ratio of hydrogen to hydrocarbon and a feed rate of 1.43 $hr^{-1}$ LHSV. The $C_5$+ liquid yield was 92.7 wt %. The hydrogen production was 975 standard cubic feet per barrel feed.

This $C_5$+ liquid product (penultimate effluent) collected from the penultimate stage had an API of 46.6, an RON of 89 and an ASTM D-2887 simulated distillation as given in Table 2.

TABLE 1

Simulated Distillation of naphtha feed

| Vol % | Temperature, ° F. |
|---|---|
| IBP | 182 |
| 10 | 199 |
| 30 | 227 |
| 50 | 258 |
| 70 | 291 |
| 90 | 336 |
| EP | 386 |

TABLE 2

Simulated Distillation of the $C_5$+ liquid product from the penultimate stage (penultimate effluent)

| Vol % | Temperature, ° F. |
|---|---|
| IBP | 165 |
| 10 | 189 |
| 30 | 234 |
| 50 | 257 |
| 70 | 289 |
| 90 | 336 |
| EP | 411 |

Example 2

The $C_5$+ liquid product from Example 1 was distilled into an intermediate reformate and a heavy reformate. The intermediate reformate was found to represent 80 vol % of the $C_5$+ liquid product from Example 1. The intermediate reformate, had an API of 55.7, an RON of 85 and an ASTM D-2887 simulated distillation as shown in Table 3, and was used as feed in a final reforming stage in Examples 3-6. The heavy reformate was found to represent 20 vol. % of the $C_5$+ liquid product from Example 1. The heavy reformate had an API of 28.9 and an RON of 105, and is further described in Table 4.

TABLE 3

Simulated Distillation of intermediate reformate

| Vol % | Temperature, ° F. |
|---|---|
| IBP | 168 |
| 10 | 190 |
| 30 | 235 |
| 50 | 240 |
| 70 | 284 |
| 90 | 296 |
| EP | 336 |

Example 3

The intermediate reformate produced in Example 2 was used as feed to the final reforming stage which used a ZSM-5 zeolite based catalyst composited with 35% alumina binder material. The ZSM-5 had a $SiO_2/Al_2O_3$ molar ratio of ~2000 and was ion exchanged to the ammonium form before incorporating in a 65% zeolite/35% alumina extrudate. The extrudate was impregnated with 0.8% Pt, 0.3% Na, and 0.3% Mg by an incipient wetness procedure to make the final catalyst. The reaction conditions and experimental results are listed in Tables 4 and 5.

Example 4

A product which was produced in the final stage reforming of the intermediate reformate in Example 3 was blended with the heavy reformate (Example 2) which was not subjected to the final stage reforming. The total RON of $C_5$+, total $C_5$+ yield and total $H_2$ production of the blended final product are given in Table 4 based on using the total $C_5$+ penultimate effluent as feed (which is distilled into intermediate reformate and heavy reformate in Example 2). The results are compared to those obtained from Comparative Example 1 where the total $C_5$+ product was produced from the total $C_5$+ penultimate effluent as feed, without distillation into an intermediate and heavy reformate.

Example 5

The intermediate reformate produced in Example 2 was contacted with the platinum/rhenium on alumina based catalyst described in Example 1 in a final reforming stage. The reaction conditions and experimental results are listed in Table 5 and compared with Example 3.

Example 6

The intermediate reformate produced in Example 2 is contacted with the platinum/rhenium on alumina based catalyst described in Example 1 in a final reforming stage wherein the final reforming stage pressure is less than 200 psig. The final reforming stage is run at the same temperatures, LHSV, and hydrogen to hydrocarbon ratio as in Example 5. The $C_5$+ liquid yield for Example 6 is higher than the $C_5$+ liquid yield for Example 5 at the same or similar RON. The higher $C_5$+ liquid yield of Example 6 as compared to Example 5 illustrates the benefits of running the final stage at a lower pressure than the penultimate stage with a platinum/rhenium on alumina catalyst.

Comparative Example 1

The total $C_5$+ product produced in Example 1, without distillation into an intermediate and heavy reformate, was contacted with the ZSM-5 based catalyst of Example 3 in a final reforming stage at 930° F., 80 psig, 2:1 molar ratio of hydrogen to hydrocarbon and 1.5 $hr^{-1}$ LHSV feed rate. The $C_5$+ liquid yield was 89.9 wt, % and RON of the $C_5$+ liquid product from the final reforming stage was 97.4. The hydrogen production was 190 standard cubic feet per barrel feed.

TABLE 4

Comparison of results from Example 4 and Comparative Example 1

| | Example 4 | | Comparative |
|---|---|---|---|
| | Example 3 | Example 2 | Example 1 |
| Feedstock | Intermediate reformate (Example 2, Table 3) | Heavy reformate (Example 2, Table 3) | Total $C_5$+ penultimate effluent (Example 1, Table 2) |
| Catalyst | Pt/Na/Mg/ZSM-5 with alumina binder | Not subjected to the final stage reforming | Pt/Na/Mg/ZSM-5 with alumina binder |
| Temperature, ° F. | 900 | — | 930 |
| Pressure, psig | 80 | — | 80 |
| LHSV, $hr^{-1}$ | 1.5 | — | 1.5 |
| Molar $H_2$/hydrocarbon Ratio | 2:1 | — | 2:1 |
| RON of $C_5$+ | 97.0 (1) | 105 (2) | 97.4 (3) |
| $C_5$+ Yield, wt % | 92.7 (1) | 100 (2) | 89.9 (3) |
| $H_2$ Yield, scf/bbl feed | 300 (1) | — | 190 (3) |
| Total RON of $C_5$+ | 98.7 (4) | 97.4 (3) | |
| Total $C_5$+ Yield, wt % | 94.2 (4) | 89.9 (3) | |
| Total $H_2$ Yield, scf/bbl feed | 240 (4) | 190 (3) | |

Notes to Table 4:

(1) For Example 3: RON of $C_5$+, $C_5$+ yield and $H_2$ production of the product are given based on the intermediate reformate as feed.

(2) For Example 2: RON of $C_5$+ and $C_5$+ yield are given based on the heavy reformate which is not subjected to the final stage reforming.

(3) For Comparative Example 1: RON of $C_5$+, $C_5$+ yield and $H_2$ production of the product are given based on the total $C_5$+ penultimate effluent as feed.

(4) For Example 4: Total RON of $C_5$+, total $C_5$+ yield and total $H_2$ production are given based on the total $C_5$+ penultimate effluent as feed (which is distilled into intermediate reformate and heavy reformate in Example 2). The final product of Example 4 consists of a blend of (i) the product from the final stage reforming of the intermediate reformate and (ii) the heavy reformate which is not subjected to the final stage reforming.

Table 4 demonstrates the benefits of the present invention when using the intermediate reformate as the feedstock at lower reaction temperature (900° F. vs. 930° F.) by showing improved hydrogen yield, higher $C_5$+ liquid yield and higher RON versus the full boiling range $C_5$+ feedstock.

TABLE 5

Comparison of results from Example 3 and Example 5

| | Example 3 | | Example 5 | |
|---|---|---|---|---|
| Catalyst | Pt/Na/Mg/ZSM-5 with alumina binder | | Pt/Re with alumina binder | |
| Feedstock | Intermediate reformate (Example 2) | Intermediate reformate (Example 2) | Intermediate reformate (Example 2) | Intermediate reformate (Example 2) |
| Temperature, ° F. | 900 | 950 | 910 | 940 |
| Pressure, psig | 80 | 80 | 200 | 200 |
| LHSV, $hr^{-1}$ | 1.5 | 1.5 | 1.5 | 1.5 |
| Molar $H_2$/hydrocarbon Ratio | 2:1 | 2:1 | 5:1 | 5:1 |
| RON of $C_5$+ | 97.0 | 100.6 | 96.9 | 101.8 |
| $C_5$+ Yield, wt % | 92.7 | 88.4 | 88.9 | 85.2 |
| $H_2$ Yield, scf/bbl feed | 300 | 430 | 130 | 175 |

Table 5 demonstrates a preferred embodiment of the present invention, wherein the pressure of the final stage reactor is lower than the pressure in the penultimate stage. Improvements at the lower pressure with the ZSM-5 based catalyst in terms of $C_5$+ yield and hydrogen production at similar $C_5$+ RON are seen versus the Pt/Re catalyst at higher pressure.

What is claimed is:

1. A reforming process comprising:

a. contacting a naphtha boiling range feedstock in a penultimate stage of a multi-stage reforming process at a first reforming pressure with a first reforming catalyst to produce a penultimate effluent;

b. contacting at least a portion of the penultimate effluent in a final stage of the multi-stage reforming process at a second reforming pressure with a second reforming catalyst to produce a final effluent comprising a final reformate, wherein the final reformate has a target RON that is higher than the intermediate reformate;

c. regenerating the final stage catalyst while reforming is taking place in the penultimate stage; and d. temporarily increasing the severity of the penultimate stage to meet the RON target for the product reformate while the final stage catalyst is being regenerated.

2. The process of claim 1, wherein the first reforming catalyst comprises a Group VIII metal and a promoter supported on a porous refractory inorganic oxide support.

3. The process of claim 2, wherein the Group VIII metal is platinum.

4. The process of claim 2, wherein the catalyst comprises platinum and rhenium on an alumina support.

5. The process of claim 1, wherein the second reforming catalyst comprises a Group VIII metal and a promoter supported on a porous refractory inorganic oxide support.

6. The process of claim 5 wherein the Group VIII metal is platinum.

7. The process of claim 5, wherein the porous refractory inorganic oxide support is alumina, silica, or mixtures thereof.

8. The process of claim 5 wherein the second reforming catalyst comprises platinum and rhenium on an alumina support.

* * * * *